US010882103B2

(12) United States Patent
Kang et al.

(10) Patent No.: US 10,882,103 B2
(45) Date of Patent: Jan. 5, 2021

(54) CENTRIFUGAL CASTING APPARATUS AND CENTRIFUGAL CASTING METHOD

(71) Applicants: Hyundai Motor Company, Seoul (KR); Kia Motors Corporation, Seoul (KR)

(72) Inventors: Mun-Gu Kang, Gyeonggi-do (KR); Young-Chan Kim, Gyeonggi-do (KR); Min-Soo Kim, Seoul (KR); Hee-Sam Kang, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 162 days.

(21) Appl. No.: 16/168,660

(22) Filed: Oct. 23, 2018

(65) Prior Publication Data

US 2019/0151938 A1 May 23, 2019

(30) Foreign Application Priority Data

Nov. 23, 2017 (KR) ..... 10-2017-0157444

(51) Int. Cl.
*B22D 13/04* (2006.01)
*B22D 13/10* (2006.01)

(52) U.S. Cl.
CPC ..... *B22D 13/04* (2013.01); *B22D 13/101* (2013.01)

(58) Field of Classification Search
CPC ..... B22D 13/026; B22D 13/04; B22D 13/10; B22D 13/101; B22D 13/12
See application file for complete search history.

(56) References Cited

U.S. PATENT DOCUMENTS

2018/0056378 A1* 3/2018 Lee ..... B21D 51/10

FOREIGN PATENT DOCUMENTS

KR 2016-0114259 A 8/2017

* cited by examiner

*Primary Examiner* — Kevin E Yoon
(74) *Attorney, Agent, or Firm* — Mintz Levin Cohn Ferris Glovsky and Popeo, P.C.; Peter F. Corless

(57) ABSTRACT

A centrifugal casting apparatus is provided. The centrifugal casting apparatus includes an upper mold machined to have an inner contour used to form an upper side surface of a casting, and a lower mold machined to have an inner contour used to form a lower side surface of the casting. An upper motor provides power to rotate the upper mold and a lower motor provides power to rotate the lower mold. The upper motor and the lower motor are operated independently of each other.

9 Claims, 9 Drawing Sheets

Related Art

Related Art

Related Art

CENTRIFUGAL CASTING APPARATUS AND CENTRIFUGAL CASTING METHOD

CROSS-REFERENCE TO RELATED APPLICATIONS

This application claims priority to Korean Patent Application No. 10-2017-0157444, filed on Nov. 23, 2017, the disclosure of which is incorporated herein by reference in its entirety.

BACKGROUND

Field of the Invention

The present invention relates to a centrifugal casting apparatus and method for casting products using centrifugal force.

Description of the Related Art

A centrifugal casting method is used to manufacture high quality castings of complex shapes in the field of gravity casting, which is used to manufacture various automotive parts. FIG. 1 shows a centrifugal casting apparatus in the related art for casting a damper pulley that is one of automobile parts. In the conventional centrifugal casting method, a casting is manufactured in the form as shaped in a casting mold by joining together an upper mold 1 and a lower mold 2, which have an inner or an outer surface shape that corresponds to the outer shape of a casting, injecting molten metal through a molten metal injection port 3 of the upper mold 1 and then rotating the upper mold 1 and the lower mold 2 with respect to the vertical axis thereof.

As for the damper pulley shown in FIG. 1 of the related art, the upper mold 1 is machined to have an inner surface shape that conforms to shapes of the top and outer peripheral surfaces of the damper pulley and the lower mold 2 is machined to have an outer surface shape that conforms to shapes of the bottom and inner peripheral surfaces of the damper pulley. However, the upper mold may be machined to have a shape that corresponds to the shape of the inner peripheral surface of the casting and the lower mold may be machined to have a shape that corresponds to the shape of the outer peripheral surface of the casting.

In the centrifugal casting process in which molten metal is injected during simultaneous rotation of the upper and lower molds and molding is performed by a centrifugal force of the molten metal, scraps occur due to excessive risers since the molds are rotated due to the nature of the process, and thus, a separate pressurizing apparatus is unable to be mounted, shrinkage defects are generated in the product part due to cooling rate, and a further process for removing risers is required.

In addition, molds are designed to form excessive risers as in a gravity casting technique, as shown in FIG. 2 of the related art, since bubbles and pores are gathered together in a design shape in a direction of a centripetal force. If the riser is not large, final solidification progresses in the product part rather than in the riser, which generates shrinkage defects in the product part. Accordingly, there were attempts to suppress generation of bubbles in the direction of the centripetal force. However, bubbles are still generated in the direction of the centripetal force as shown in FIG. 3 of the related art due to limitation of pressurizing force by the riser.

The above information disclosed in this section is merely for assisting understanding of the background of the invention and it may therefore contain information that does not form the prior art that is already known to those who have ordinary skill in the art.

SUMMARY

The present invention provides a centrifugal casting apparatus and a centrifugal casting method that may improve quality of products by reducing shrinkage defects in a product part and simplifying manufacturing process and reducing cost since risers may be eliminated and thus a process for removing risers may be eliminated.

Other objects and advantages of the present invention may be understood by the following description and become apparent with reference to the exemplary embodiments of the present invention. Also, it is obvious to those skilled in the art to which the present invention pertains that the objects and advantages of the present invention may be realized by the means as claimed and combinations thereof.

In accordance with one aspect of the present invention, a centrifugal casting apparatus may include an upper mold machined to have an inner contour used to form an upper side surface of a casting; a lower mold machined to have an inner contour used to form a lower side surface of the casting; an upper motor configured to provide power to rotate the upper mold; and a lower motor configured to provide power to rotate the lower mold. The upper motor and the lower motor may be operated independently of each other.

Further, at least one of the upper mold or the lower mold may include a machined portion having a profile that corresponds to an inner peripheral surface or an outer peripheral surface of the casting only at a partial section of a rotational surface with respect to a rotational axis. In addition, ends of the upper mold and the lower mold may include steps that correspond to each other to separate the upper mold and the lower mold.

In accordance with another aspect of the present invention, a centrifugal casting apparatus may include an upper mold machined to have an inner contour used to form an upper side surface of a casting and a lower mold machined to have an inner contour used to form a lower side surface of the casting. The upper mold and/or the lower mold may include a machined portion having a profile that corresponds to the inner peripheral surface or the outer peripheral surface of the casting only at a partial section of a rotational surface with respect to a rotational axis.

In accordance with still another aspect of the present invention, a centrifugal casting method may include rotating an upper mold machined to have an inner contour used to form an upper side surface of a casting and a lower mold machined to have an inner contour used to form a lower side surface of the casting with respect to one and the same rotational axis.

The upper mold and the lower mold may be operated independently of each other. In particular, rotational speeds and/or directions of the upper mold and the lower mold may be set differently.

According to the centrifugal casting apparatus and the centrifugal casting method of the present invention, risers may be eliminated since pressure effect may be greater than in the related art, and an overall process may be simplified and the cost may be reduced since an additional process for eliminating risers may be omitted.

Further, shrinkage defects of products may be minimized by virtue of the pressure effect, occurrence of bubbles may be suppressed, and thus, quality of products may be enhanced. Since portions of molds to be machined may be reduced, the cost to fabricate the molds may be reduced due to reduction of machining and less mold material used. Moreover, there is an effect of increased strength by work hardening of a semi-solid or high-temperature solid shape.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

In order to fully understand the present invention, operational advantages of the present invention and objects achieved by implementing the present invention, the accompanying drawings exemplifying embodiments of the present invention and contents described in the accompanying drawings need to be referred to. In describing the exemplary embodiments, detailed description of technology known in the art or iterative description may be shortened or omitted to avoid obscuring the subject matter of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
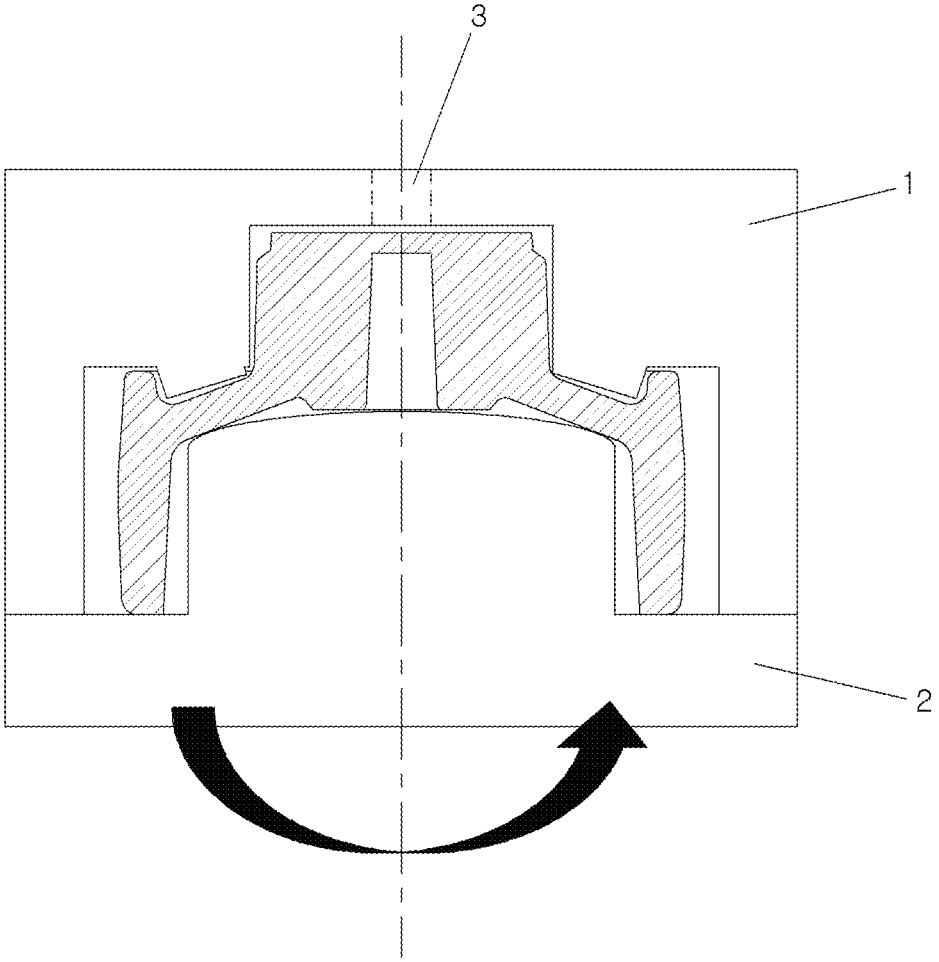
FIG. 1 is a schematic view of a centrifugal casting apparatus in the related art.
Figure 2:
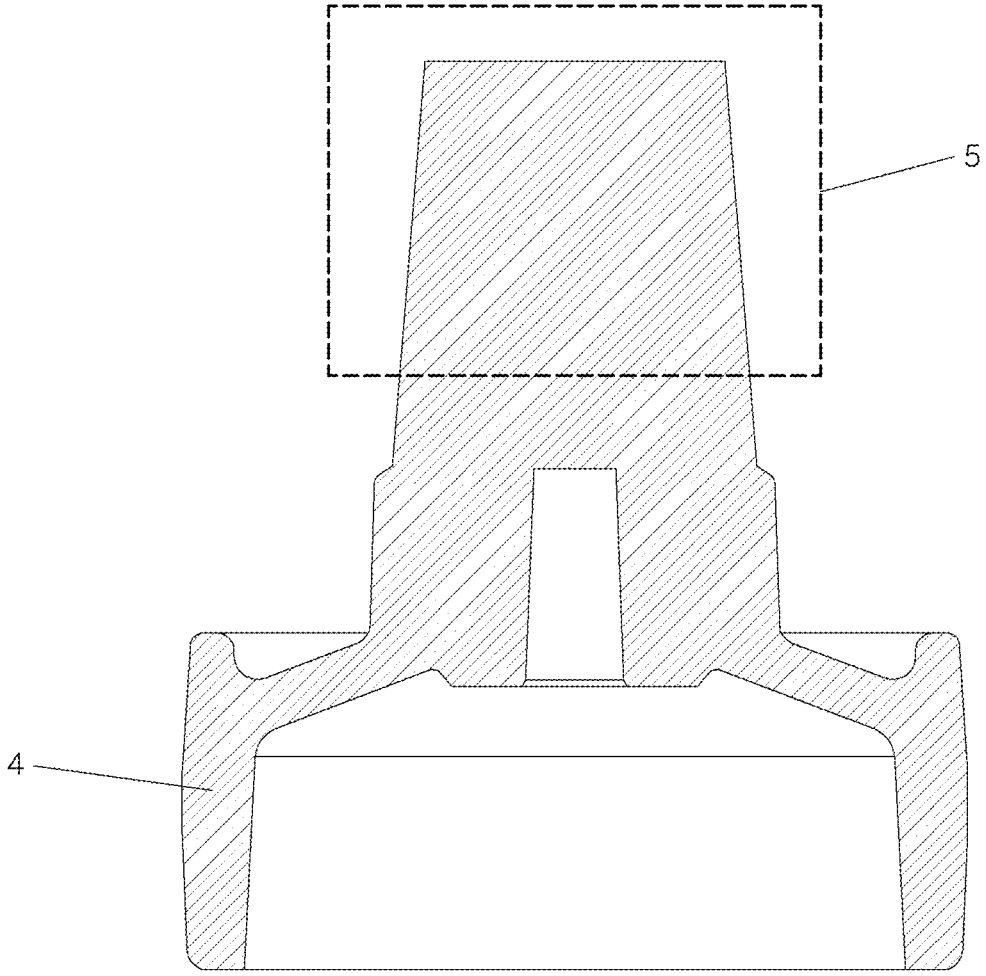
FIG. 2 shows a riser of a product manufactured by the apparatus of FIG. 1 in the related art.
Figure 3:
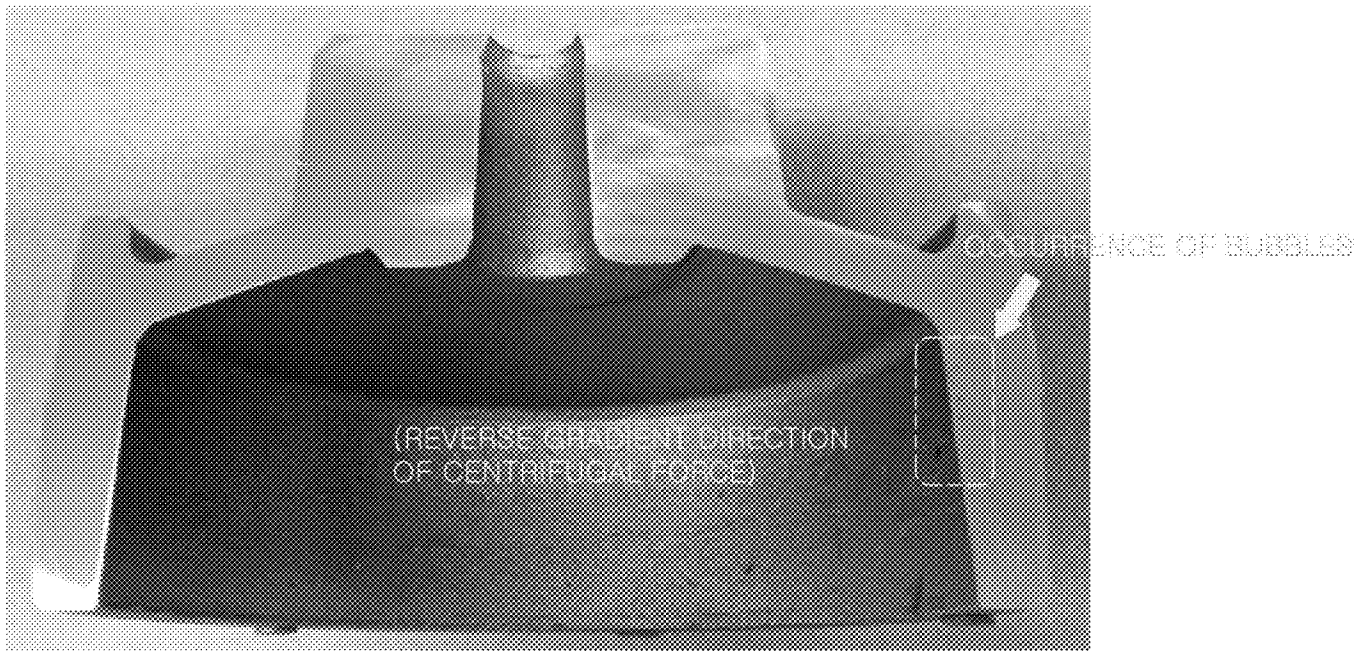
FIG. 3 shows defects of a product manufactured by the apparatus of FIG. 1 in the related art.
Figure 4:
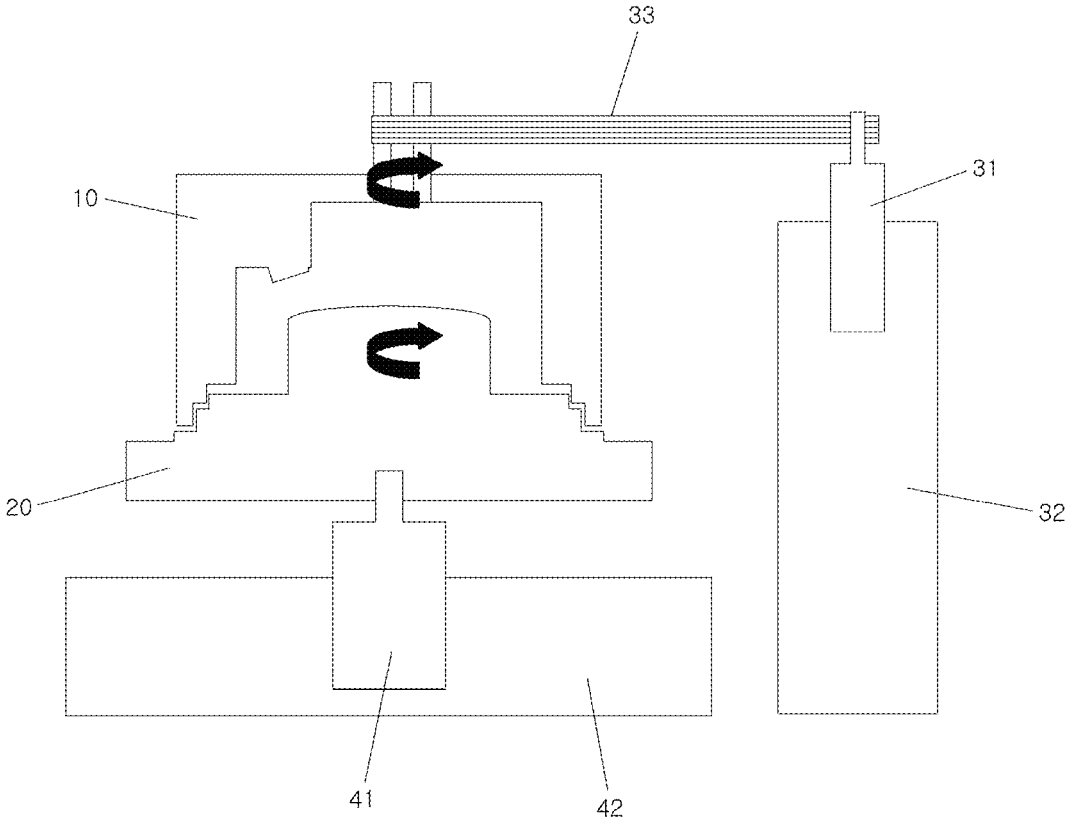
FIG. 4 is a schematic view of a centrifugal casting apparatus according to an exemplary embodiment of the present invention.
Figure 5:
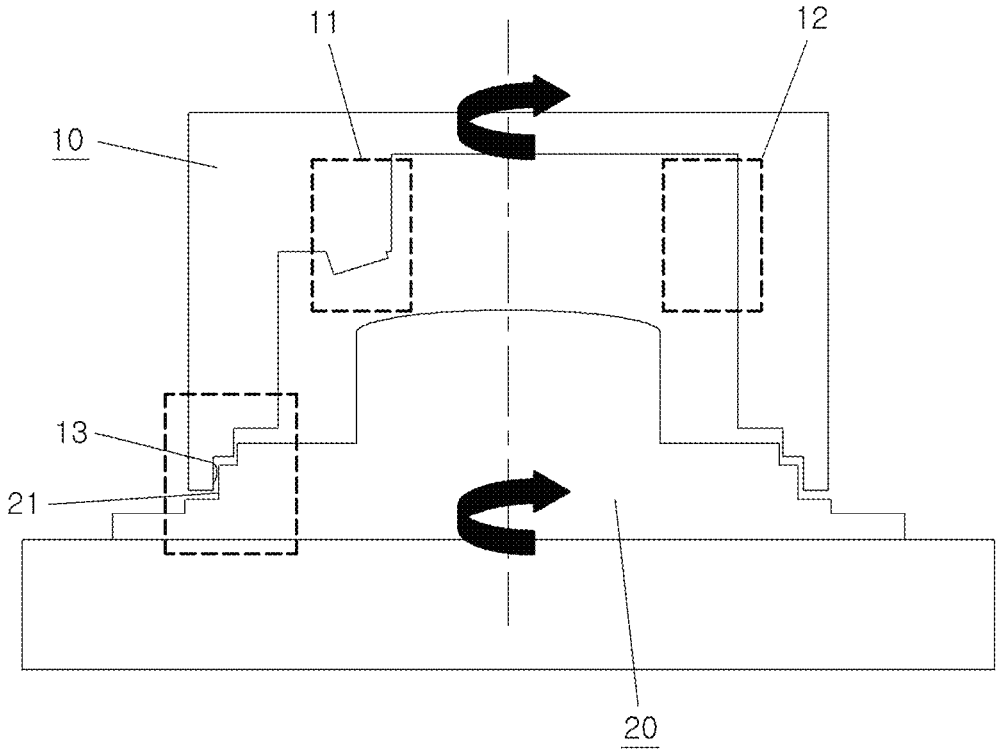
FIG. 5 is a partial view of the centrifugal casting apparatus of FIG. 4 according to an exemplary embodiment of the present invention.

FIG. 4 is a schematic view of a centrifugal casting apparatus according to an exemplary embodiment of the present invention, and FIG. 5 is a partial view of the centrifugal casting apparatus of FIG. 4 according to an exemplary embodiment of the present invention. A centrifugal casting apparatus and a centrifugal casting method according to an exemplary embodiment of the present invention will be described below with reference to FIGS. 4 and 5.

A centrifugal casting apparatus according to an exemplary embodiment of the present invention may include an upper mold 10 and a lower mold 20 which are prepared to be separated from each other. The apparatus may include an upper mold motor 31, an upper mold support 32, a lower mold motor 41, a lower mold support 42, and a belt 33 for power transmission to rotate each of the upper mold 10 and the lower mold 20 about a vertical axis.

In the centrifugal casting method according to an exemplary embodiment of the present invention, the upper mold 10 and the lower mold 20 may be operated to rotate at different directions and/or speeds by the upper mold motor 31 and the lower mold motor 41, respectively, thereby further enhancing pressurizing effect compared to rotating the two molds simultaneously. In other words, the upper mold may be rotated clockwise and the lower mold may be rotated counterclockwise and vice versa. In addition, the upper and lower molds may be rotated in the same direction but at different speeds. Further, one mold may be rotated while the other is not. Rotating the two molds independently may increase pressurizing force more than rotating the two molds simultaneously or at the same speed, which will be described later.

The upper mold 10 may include a molten metal injection port for injecting molten metal therein and may be machined to have an inner contour that corresponds to a shape of an upper side surface of a casting. The lower mold 20 may be machined to have an inner contour that corresponds to a shape of a lower side surface of a casting. The term "inner' as used herein refers to the inner side of an entire mold formed by joining together the upper and lower molds. Further, the upper mold and the lower mold may be machined to have an inner contour that corresponds to the inner peripheral surface or the outer peripheral surface of the casting. An exemplary casting of the present invention is a damper pulley for motor vehicles. For example, the upper mold may include an inner contour that corresponds to a shape of the upper side and outer peripheral surfaces of the damper pulley while the lower mold may include an inner contour that corresponds to the lower side and inner peripheral surfaces of the damper pulley.

In particular, at least one of the upper mold 10 or the lower mold 20 of the present invention may be machined to have an inner contour that does not correspond to (e.g., that differs from) an overall shape that conforms to the outer peripheral shape or the inner peripheral shape of the casting. Instead, only a partial section of the upper mold 10 and/or the lower mold 20 may be machined to have an inner contour that conforms to the overall shape. In other words, the upper mold 10 may be machined to include a machined portion 11 which is a portion of the mold that is machined to have a profile that corresponds to the outer peripheral shape of the damper pulley, while a non-machined portion 12, which is a remaining portion having the same rotational surface as the machined portion 11, may have a profile that is different from the outer peripheral shape of the damper pulley.

In the present invention, any one of the upper and lower molds may be machined to include a portion of the mold that is machined to have the profile that corresponds to the outer shape of the casting, and thereby the machined portion may further press the remaining portion having the same rotational surface as the machined portion while it rotates. Such a portion of the mold that is partially machined for effective pressurization may be referred to as a pressurizing fan or a squeeze fan. The squeeze fan may be formed in an angular range of about 10 degrees out of a rotational surface of 360 degrees, but the angular range is not limited thereto.

Further, since the upper mold 10 and the lower mold 20 of the present invention may be operated to rotate separately, a friction surface may be required to be removed. Therefore, although the upper and lower molds may be joined to allow an end 13 of the upper mold 10 and an end 21 of the lower mold 20 to be adjacent to each other, leakage of the molten metal may occur through a gap since the two molds are spaced apart from each other. To prevent the leakage of the molten metal, the end 13 of the upper mold 10 and the end 21 of the lower mold 20 of the present invention may respectively have steps which correspond to each other. The steps may include a plurality of horizontal and vertical surfaces disposed at different heights to provide a tortuous path that prevents leakage. Further, bearings may be disposed at the outermost ends of the two molds to facilitate rotation of the molds.

Figure 6A:
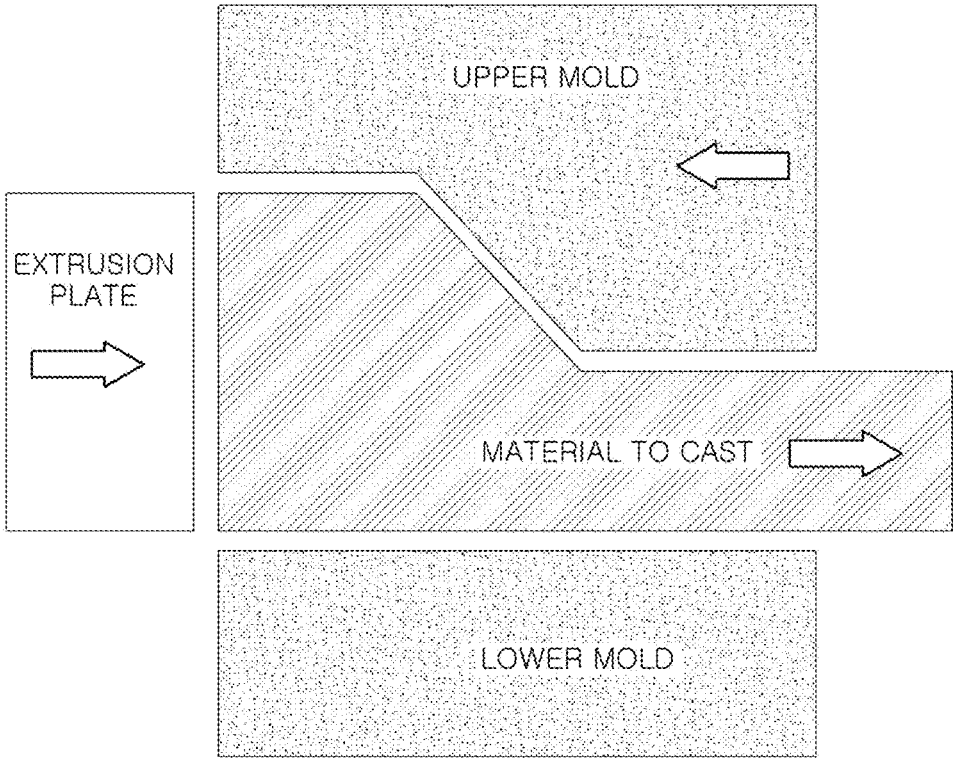
FIGS. 6A and 6B are views for comparing pressurizing force in an extrusion process with that in a centrifugal casting method according to an exemplary embodiment of the present invention.
Figure 6B:
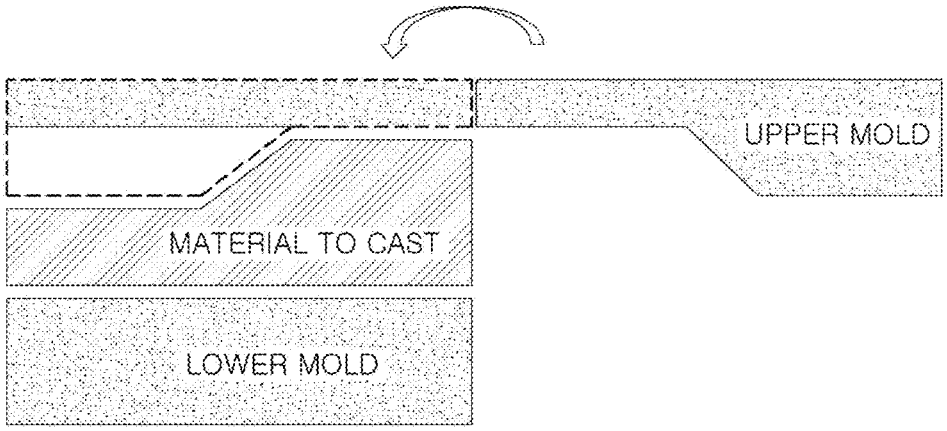

FIG. 6A shows the pressurizing effect by an extrusion process. As shown in FIG. 6A, the extrusion process may enable the material to be pressurized by an extrusion plate and shapes of molds. Flow stress of the material may vary depending on pushing speed (e.g., pressurizing rate) of the extrusion plate, and molding of the material may be performed by pressure that results from the flow stress beyond the yield stress of the material. FIG. 6B is a conceptual view that illustrates the centrifugal casting method according to an exemplary embodiment of the present invention. Since only a portion of a mold (e.g., upper mold) is machined to have a profile of a product, a squeeze fan may pressurize the material while rotating to apply pressure effect similar to that in the extrusion process described in FIG. 6A.

Figure 7:
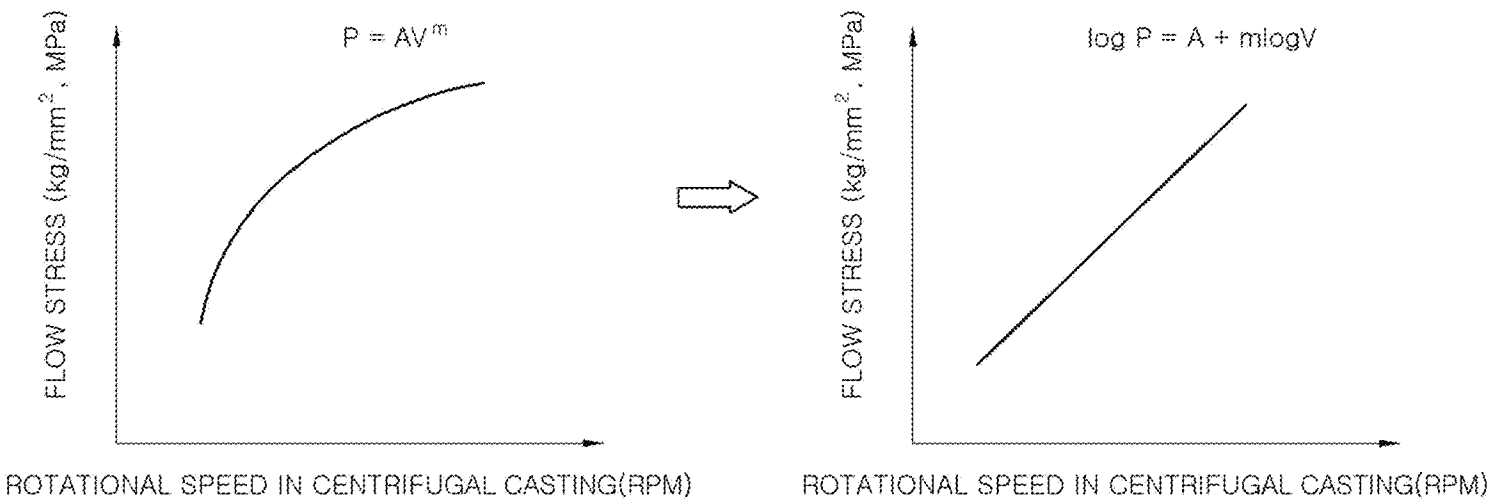
FIG. 7 shows pressurizing force depending on rotational speed in the centrifugal casting method.

FIG. 7 shows pressurizing force depending on rotational speed in the centrifugal casting method. Referring to FIG. 7, generation of the pressurizing force that results from difference between speeds of the upper and lower molds will be theoretically discussed below.

The pressurizing force P may be expressed by the following equation.

$$P=AV^m \qquad \text{Equation 1}$$

wherein P represents pressure (kg/mm$^2$, MPa), A represents a proportional constant, m represents an exponential constant (<1, strain exponent), and V represents a pressurizing rate (m/s).

Accordingly, as the rotational speed of the centrifugal casting increases, the flow stress received by the material increases, and moreover, when the flow stress received by the material exceeds the yield stress of the material, plastic deformation of the material occurs. If the turning radius of the centrifugal casting is 1 meter, the rotational speed (e.g., in unit of RPM) may be converted into a pressurizing rate as in the extrusion process. For example, 10 RPM may be converted into 1.05 m/s, 100 RPM into 10.5 m/s, and 1,000 RPM into 105 m/s. The yield stress of the material in the centrifugal casting method may range between 0.1 MPa to 1,000 MPa. The lowest value of 0.1 MPa corresponds to about 1 atmospheric pressure (0.1 MPa) due to weight of the molten metal and the maximum value of 1,500 MPa corresponds to the maximum yield strength of solid metal (Fe) at high temperature (for reference, the maximum value for aluminum is 500 MPa). Further, the rotational speed in the centrifugal casting method may range between 1 RPM to 10,000 RPM. If the turning radius is 1 m, the rotational speed may be converted into pressurizing rates of 0.1 m/s to 1,046 m/s, whereas if the turning radius is 1 cm, the rotational speed may be converted into pressurizing rates of 0.001 m/s to 10.5 m/s.

Figure 8:
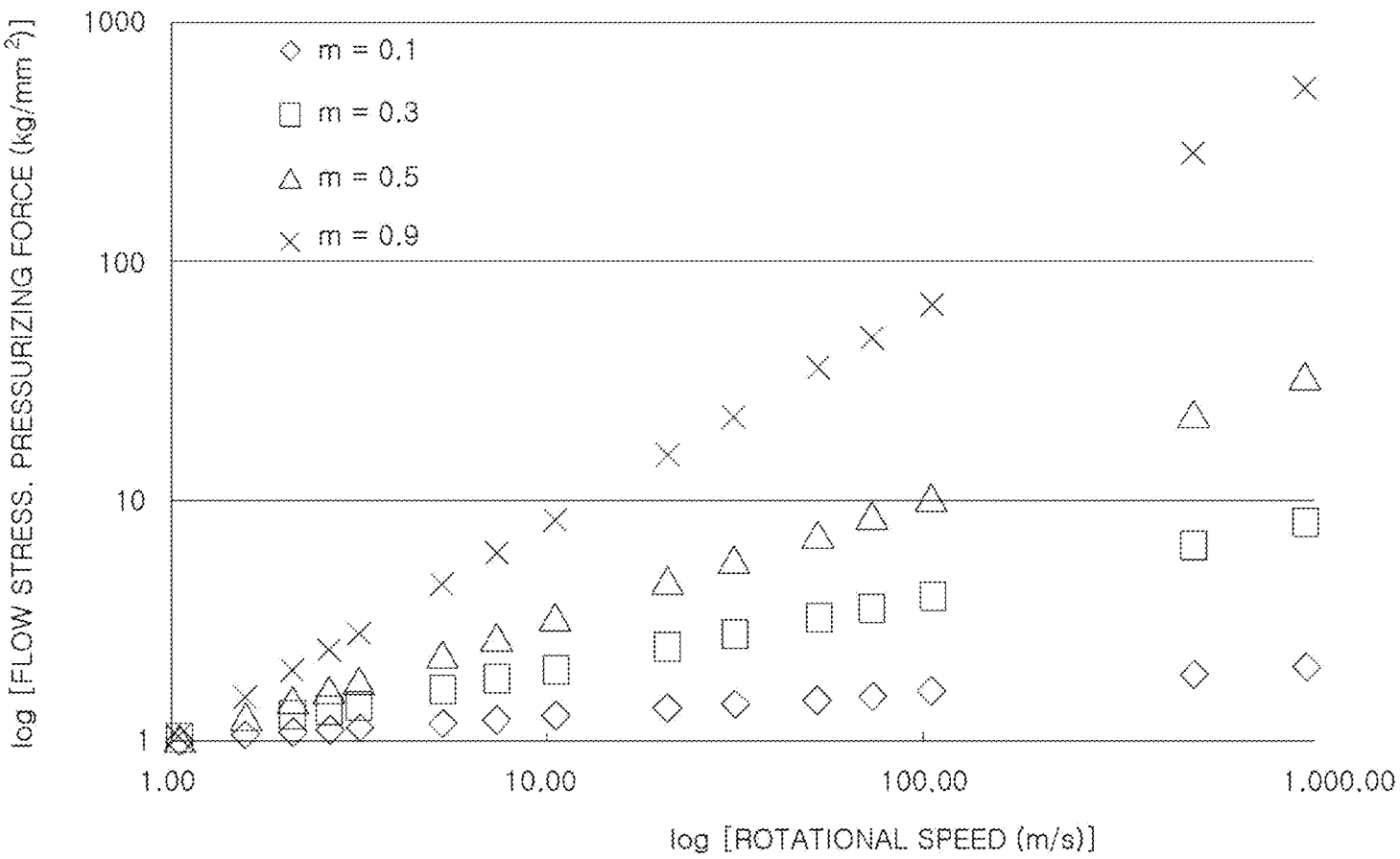
FIG. 8 shows relationship between rotational speed and flow stress in the centrifugal casting method.

FIG. 8 shows a relationship between rotational speed and flow stress in the centrifugal casting method. Assuming that A=1 and m=0.1, the flow stress may be 1.0 kg/mm$^2$ (10.0 MPa) at 10 RPM (1.05 m/s) and 1.6 kg/mm$^2$ (16.0 MPa) at 1,000 RPM (104.6 m/s); assuming that A=1 and m=0.9, the flow stress may be 1.0 kg/mm$^2$ (10.4 MPa) at 10 RPM (1.05 m/s) and 65.7 kg/mm$^2$ (657.3 MPa) at 1,000 RPM (104.6 m/s); and assuming that A=1 and m=0.9, the flow stress may be 522.1 kg/mm$^2$ (5,221.8 MPa) at 10,000 RPM (1,046 m/s).

As seen from the above condition (i.e., A=1, m=0.1 to 0.9), the flow (pressurizing) stress generated depending on the rotational speed may be calculated. Therefore, when the flow stress generated by the rotational speed is greater than the yield stress of the material in the centrifugal casting process, the material may be pressurized. For example, when the yield stress of the aluminum alloy (AC4CH, A=1, m=0.9) at room temperature is 100 MPa (10 kg/mm$^2$) and the flow yield stress at high temperature (600° C.) is 1 MPa (0.1 kg/mm$^2$), pressurizing force at room temperature may require a rotational speed of 20 m/s (200 RPM) or more, which corresponds to the flow stress of 100 MPa (10 kg/mm$^2$) or more in FIG. 8, while pressurizing force at high temperature may require a rotational speed of 0.1 m/s (1 RPM) or more, which corresponds to the flow stress of 1 MPa (0.1 kg/mm$^2$) or more.

Therefore, although the rotational speed for pressing force required in the centrifugal casting process depends on the yield stress of the material, the rotational speed may be ranged between at least 1 RPM and at most 10,000 RPM. The minimum and maximum rotational speeds may refer to a difference between speeds of the upper and lower molds.

Accordingly, when the upper and lower molds rotate simultaneously as in the conventional centrifugal casting, no pressurizing force is generated since the material also rotates in the same manner as the rotation of the molds. Conversely, a pressurizing force may be exerted to the material when the difference between speeds of the upper and lower molds occurs as provided by the present invention. Further, pressurizing may be applied to a semi-solid material and a solid material (material at 50° C. to 1,000° C.) as well as the molten metal, and the material to cast may include all metal-based materials.

As described above, according to the centrifugal casting method using the centrifugal casting apparatus of the present invention, a pressurizing force may be exerted to a material to be casted by the speed difference between the upper and lower molds, and casting may be performed by pressurizing the material with a squeeze fan of the upper mold or the lower mold to further enhance quality of cast products. In addition, since risers and a process for removing the risers may be eliminated, the casting process may become more efficient.

Although the present invention has been described in the foregoing with reference to the drawings illustrated by way of example, the present invention is not limited to the disclosed exemplary embodiments, and it will be apparent to those of ordinary skill in the art that various modifications and variations may be made to the present invention without departing from the spirit and scope of the invention. Therefore, such modifications or variations fall within the scope of the present invention as claimed and the scope of the present invention should be interpreted based on the appended claims.

What is claimed is:

1. A centrifugal casting apparatus, comprising:

injecting molten metal through an upper mold; and an upper mold machined to have an inner contour used to form an upper side surface of a casting;

a lower mold machined to have an inner contour used to form a lower side surface of the casting;

an upper motor configured to provide power to rotate the upper mold; and a lower motor configured to provide power to rotate the lower mold, wherein the upper motor and the lower motor are operated independently of each other.

2. The centrifugal casting apparatus according to claim 1, wherein at least one of the upper mold or the lower mold includes a machined portion having a profile that corresponds to an inner peripheral surface or an outer peripheral surface of the casting at a partial section of a rotational surface with respect to a rotational axis.

3. The centrifugal casting apparatus according to claim 2, wherein the machined portion is formed in an angular range of about 10 degrees with respect to the rotational axis.

4. The centrifugal casting apparatus according to claim 2, wherein ends of the upper mold and the lower mold include steps that correspond to each other to separate the upper mold and the lower mold.

5. A centrifugal casting method, comprising:

rotating, with respect to a rotational axis, the upper mold machined to have an inner contour used to form an upper side surface of a casting and a lower mold machined to have an inner contour used to form a lower side surface of the casting, wherein the upper mold and the lower mold are rotated independently of each other.

6. The centrifugal casting method according to claim 5, wherein rotational speeds of the upper mold and the lower mold are different.

7. The centrifugal casting method according to claim 6, wherein rotational directions of the upper mold and the lower mold are different.

8. The centrifugal casting method according to claim 5, wherein rotational directions of the upper mold and the lower mold are different.

9. The centrifugal casting method according to claim 5, further comprising:

determining rotational speeds of the upper mold and the lower mold to allow a flow stress to be greater than a yield stress of a material to be casted based on a relationship between the rotational speeds and the flow stress.

* * * * *